US005823674A

United States Patent [19]

Liechti et al.

[11] Patent Number: 5,823,674

[45] Date of Patent: Oct. 20, 1998

[54] KNEADER MIXER

[75] Inventors: Pierre Liechti, Muttenz; Alfred Kunz, Witterswil; Jörg List, Pratteln, all of Switzerland; Daniel Arnaud, Hiersignue, France

[73] Assignee: List AG, Arisdorf, Switzerland

[21] Appl. No.: 784,264

[22] Filed: Aug. 28, 1996

[30] Foreign Application Priority Data

Dec. 12, 1995 [DE] Germany ..... 195 33 693.3

[51] Int. Cl.[6] ..... B01F 7/00

[52] U.S. Cl. ..... 366/303; 366/307

[58] Field of Search ..... 366/302, 303, 366/304, 307, 309, 312, 313, 315, 316, 317, 325.92, 325.2, 325.4, 325.5, 325.9

[56] References Cited

U.S. PATENT DOCUMENTS

| | | | |
|---|---|---|---|
| Re. 23,772 | 1/1954 | Spencer | 366/303 |
| 2,729,545 | 1/1956 | Reman et al. | 366/315 |
| 3,563,710 | 2/1971 | Dew, Jr. et al. | 366/315 |
| 4,389,119 | 6/1983 | Valsamis et al. | 366/315 |
| 4,775,243 | 10/1988 | Baumgartner | 366/303 |
| 4,826,324 | 5/1989 | Kunz et al. | 366/309 |
| 4,889,431 | 12/1989 | Liechti | 366/303 |
| 4,941,130 | 7/1990 | List et al. | 366/309 |
| 5,121,992 | 6/1992 | List et al. | 366/303 |
| 5,147,135 | 9/1992 | List et al. | 366/303 |

*Primary Examiner*—Tony G. Soohoo
*Attorney, Agent, or Firm*—Bachman & LaPointe, P.C.

[57] ABSTRACT

In a kneader mixer for the thermal or chemical treatment of products in liquid, pasty and/or powdered form within a housing (1), a kneader shaft (20) which is provided with blade elements (25) and rotates around an axis of rotation (A) is arranged. Between the blade elements (25) there are kneading-support elements (27, 43) having in each case a foot (32) fastened on the housing. The blade element(s) (35) is (are) arranged in blade planes (E) perpendicular to the kneader shaft. In this connection, the foot (32) of the kneading-support element (27, 43) also lies in the plane (E) of the blade element(s) (25).

11 Claims, 4 Drawing Sheets

KNEADER MIXER

BACKGROUND OF THE INVENTION

The present invention relates to a kneader mixer for the thermal or chemical treatment of products in liquid, pasty, or powdered state within a housing, this housing containing a kneader shaft which is provided with blade elements and rotates around an axis of rotation, kneading-support elements being arranged between the blade elements and having in each case a foot fastened on the housing, and the blade element or elements being arranged in blade planes perpendicular to the kneader shaft.

Products must beotreated today in many fields of industry, in particular in the chemical industry. For example, two chemical products must be so intimately mixed together in a kneader mixer of the type described above that they react at least in part with each other. In this connection, these products may pass through any desired aggregate state so that requirements made on a kneader mixer are very high.

Essentially, a distinction is made between single shaft and twin-shaft kneader mixers. The present invention concerns the single-shaft kneader mixer such as described for instance in European Patent Application 90 11 86 26.2 or Swiss Patent Applications 0 1726/87-6, 0 1244/90-7 or 0 0146/95-1. They have radial blade elements on a shaft on the circumference of which elements there are, as a rule, kneading bars. These kneading bars scrape along the inner wall of the housing and clean the inner wall of the housing from, for instance, incrustations of product.

In most cases, however, the blade elements themselves and the kneader shaft are heated, so that incrustations of products can take place there also. These incrustations are removed by suitably shaped kneading surfaces, these kneading-support elements in most cases together with the kneading bars or blade elements also forming a kneading slot within which the product is sheared or squeezed.

In all of these single-shaft kneader mixers, it is necessary, among other things, to remove incrustations or accumulations of product from all surfaces which come into contact with the product to be treated and, in particular, from heated surfaces. This cleaning of the surfaces is already effected to a substantial extent in the above-mentioned kneader mixers, but it has been found that a ring is formed which is not cleaned between the feet of the kneading-support elements which generally lie opposite each other in the housing. This ring may even become so thick, due to the absence of moving parts, that one can speak of the building-up of a torus. This torus can take up a large part of the cross section of the apparatus and impairs not only the quality of the product but also the transport of the product in axial direction.

Since kneading-support elements clean a blade element on one side each, two such rings are formed, namely on to the left and one to the right of the blade element.

SUMMARY OF THE INVENTION

The object of the present invention is to provide a kneader mixer of the above-mentioned type in which the elimination of incrustations or accumulations of product is further improved.

In order to achieve this object, the foot of the kneading-support element also lies in the plane of the blade element or elements.

This means that, in the direct vicinity of the uncleaned ring, the moving blade elements which make the building-up of a ring or torus impossible are present, at the foot of the kneading-support elements. In this way, the uncleaned surface is reduced to a minimum.

In one embodiment, the blade elements can consist, as previously, of two parallelly extending surfaces. One periphery of these blade elements is then spaced from the inner wall of the housing by a distance into which the foot of the kneading-support element extends. The kneading-support element is then bent at an angle around the blade element.

In a preferred embodiment of the invention, however, the blade element is to be developed in the form of a disk. In a partial cross section, this results in an approximately triangular shape, the vertex of the triangle lying in the plane of the blade elements, pointing towards the foot. This vertex is developed, viewed from the periphery, as a cutting edge so that it can readily penetrate into the product. This results in better K-values, since with the earlier kneading bars lumps of products were always pushed forward on the blade surfaces as a result of which the product was in part kept away from the blade surfaces.

If desired, for instance in order to remove vapors, recesses could also be developed in the periphery of the blade element. However, other embodiments of the blade element in the desired framework are also possible.

For the cleaning of these disk-shaped blade elements, a scraper arm is bent-off from the foot of the kneading-support element at an angle which is preferably so selected that the scraper arm extends approximately parallel to the surface of the blade element. Adjoining the scraper arm then, approximately paraxial to the kneader shaft, there is a shaft scraper which extends close to the surface of this kneader shaft. In contradistinction to earlier C-shaped hook elements, the mechanical stress, particularly in the region of the foot, is, in this case, substantially less since the scraper arm is bent-off to a lesser extent and therefore exposed to a smaller lever effect by the product. Furthermore, this kneading-support element is also simpler from a structural standpoint.

With this development, it is furthermore possible to adjust the kneading gap between scraper arm and blade element as well as between shaft scraper and kneading shaft by radial displacement. This is a substantial advantage of the invention since, by the radial displacement, a different state of the product, for instance viscosity, can also be taken into account.

Preferably, two kneading-support elements, installed radially offset from each other, are provided, the one kneading-support element scraping the one side of the blade element and the second one the opposite side. Since the feet of the kneading-support elements are, in accordance with the invention, located in the same blade plane, the building-up of a ring of product on housing wall is effectively prevented by the blade element which rotates there. The rest of the surface of the housing inner wall is cleaned by means of a cleaning element which is also arranged on the kneader shaft. This cleaning element is preferably of T-shape, a radial trunk of this cleaning element being attached to the kneader shaft. On the trunk there is placed a transverse beam which extends paraxial to or arranged close to the inner wall of the housing.

In the present invention, it is even possible to arrange two kneading-support elements such as described above on one foot. In this way, there is obtained a fork-shaped element by which both surfaces of the blade elements are cleaned. In this case, it is sufficient to associate only one fork element with each blade element, so that only one foot is present, on which a torus can in no case be built up.

Should a more intimate mixing or kneading of the product between the blade elements be desired, it has been found advisable to arrange additional teeth which mesh with each other on the kneading-support elements, particularly the scraper arm and the trunk of the cleaning elements. In this way, a plurality of kneading slots are formed, which contribute essentially to the improvement in the treatment of the product.

While, in the known kneader mixers, kneading slots are, as a rule, formed between the inner wall of the housing and the kneading beams, in the case of the present invention the teeth form kneading slots in the space between the kneader shaft and the inner wall of the housing. This arrangement of the kneading slots closer to the kneader shaft means a smaller torque for the kneader shaft and thus less power consumption upon the rotation.

By the development of the kneading-support elements of the invention, it is furthermore possible to arrange the blade elements closer together on the kneader shaft than in the prior art. This, in its turn, makes it possible for more blade elements to be arranged on a shaft, as a result of which the handling of the product is improved since the heat transfer surface is enlarged.

BRIEF DESCRIPTION OF THE DRAWINGS

Other advantages, features and details of the invention will become evident from the following description of preferred embodiments, read with reference to the drawing, in which.

DETAILED DESCRIPTION

Figure 1:
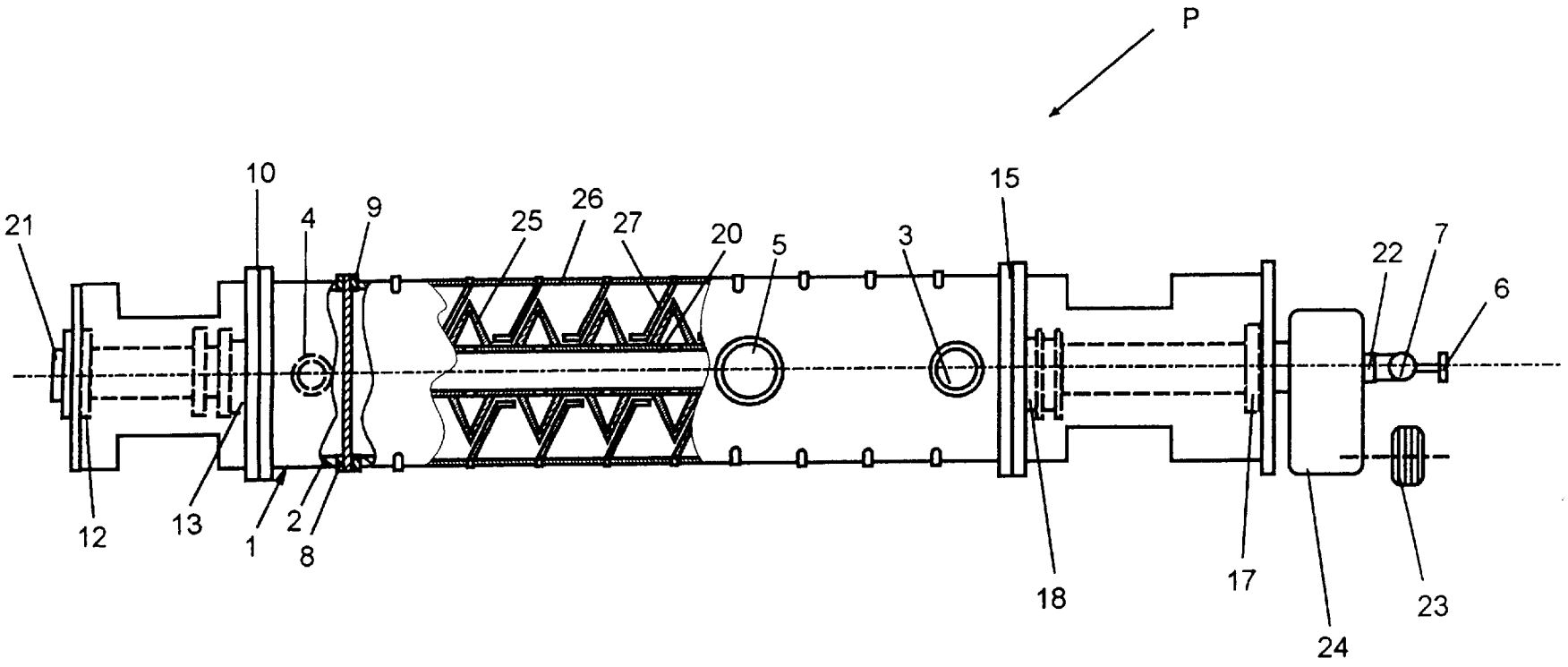
FIG. 1 is a top view of a kneader mixer in accordance with the invention, with its housing partially cut open.

A kneader mixer P in accordance with the invention has, as shown in FIG. 1, a generally horizontally arranged housing 1 with end walls 10 and 15. Within this housing there rotates a kneader shaft 20 which is supported by journals 21 and 22 in the bearings 12 and 17 on the two sides of the housing 1. In the end walls 10 and 15 there are stuffing boxes or slide-ring packings 13 and 18 which seal the rotating kneader shaft 20 off from the outside in known manner. 2 is a heating jacket for heating the housing.

The kneader shaft 20 is also preferably, in known manner, heated or cooled, an inlet 6 and an outlet 7 for the heating fluid being provided on a corresponding sealing head.

The kneader shaft 20 is driven by a motor (not shown) by means of a V-belt placed over a V-belt pulley 23, gearing 24 being furthermore interposed between the V-belt pulley 23 and the kneader shaft 20.

The kneader mixer shown in FIG. 1 is intended for continuous operation. The product is introduced through an inlet connection 3 into the inside of the housing and removed via the outlet connection 4. Furthermore, on the top, there are various connectors 5 for the discharge of exhaust vapors. In order to keep the optimal filling of the machine as far as possible within the range of 50% to 80% upon different speeds of rotation, an overflow weir 9 is provided in a flange connection 8 in front of the outlet connection 4 in the present embodiment of a kneader mixer.

On the rotating kneader shaft 20, blade elements 25 are arranged at regular distances apart, while kneading-support elements 27 are inserted in a housing wall 26. For this purpose the kneading-support elements 27 are inserted with the flange in the housing wall 26 but they can also, however, be directly welded therein.

Figure 2:
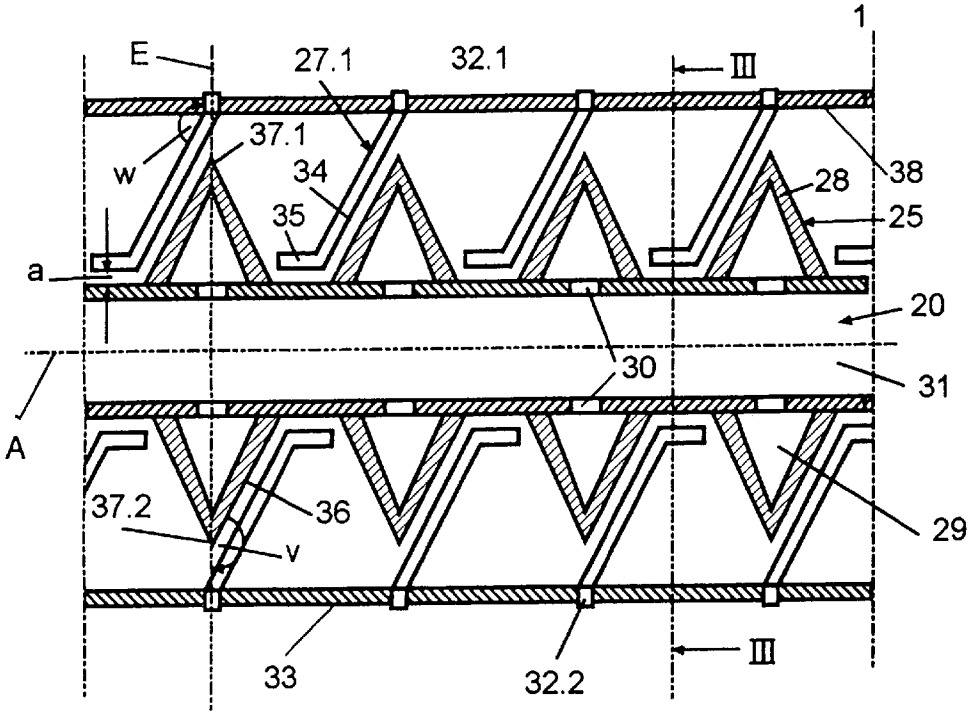
FIG. 2 is a longitudinal section through a part of the kneader mixer of FIG. 1.

FIG. 2 shows a portion of the housing 1 with inserted kneader shaft 20. In accordance with the invention, the kneader shaft 20 has disk-like blade elements 25 which are triangular or rhombic in cross section. In this connection, a blade wall 28 surrounds an annular space 29 which is in communication, via holes 30, with an axial bore 31 in the kneader shaft 20. Into this axial bore 31 there is conducted a heating fluid, which can also enter the annular space 29 through the holes 30. In this way, the blade elements 25 and blade wall 28 are also heated.

A kneading-support element 27.1 in accordance with the invention is seated by a foot 32 in the housing wall 3 and is fastened there. From this foot 32 a scraper arm 34 is bent off, the scraper arm 24 forming an angle w with the foot 32. At the other end of the foot 32, a shaft scraper 35 is attached to the scraper arm 34, it extending approximately paraxial to the axis A of the kneader shaft 20 and in this connection maintaining a slight distance a from the kneader shaft 20.

It is essential in the present invention that the scraper arm 34 extend approximately in an inclination to the Axis A parallel to a surface 36 of the blade element 25. In this connection, its foot 32 is arranged approximately in the plane E which extends through the two vertices 37.1 and 37.2 of the disk-shaped blade element 25. Thus, the angle w also corresponds to an angle v at which the surface 26 extends with respect to the plane E.

Figure 3:
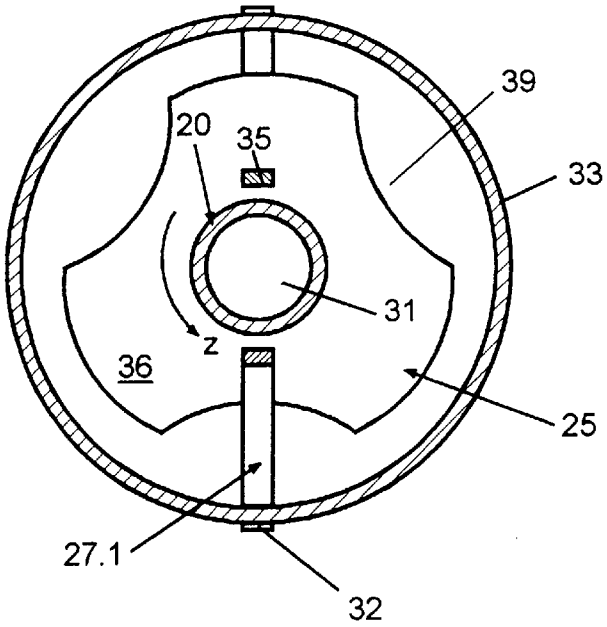
FIG. 3 is a cross section through the kneader mixer along the line III—III of FIG. 2.

The manner of operation of the present invention is as follows:

As indicated in FIG. 3, the kneader shaft 20 rotates in counterclockwise direction z. In this case, the blade element 35 cuts into a material to be worked. For instance, heat is transmitted to this material via the blade elements 25. In the present example, the blade elements 25 are furthermore provided in given regions with a recess 37. The blade elements 25 can, however, also be shaped differently, for instance in tooth-shape or undulated. They can also be provided with openings for the transport of material, etc. No limit is placed here on the inventive concept.

The only essential thing is that the surfaces 36 of the blade elements 25 are completely cleaned by the kneading-support elements 27.1. For this purpose, opposing kneading-support elements 27.1 are present in the housing 1, as shown in FIG. 2, so that a row of kneading-support elements always cleans the one side of the surfaces while this process is completed by the opposite row of kneading-support elements on the other surface.

In this connection, it can noted that the feet 32.1 and 32.2 of kneading-support elements 37.1 which are opposite each other lie relatively precisely in the plane E, so that a torus can build up as a ring on a housing inner wall 38 if at all only between said foot regions of the kneading-support elements. As is known, a torus can build up only between two static elements. In the present case, these are the foot regions between the kneading-support elements. Only here can a torus also find support by the housing inner wall 38.

Figure 4:
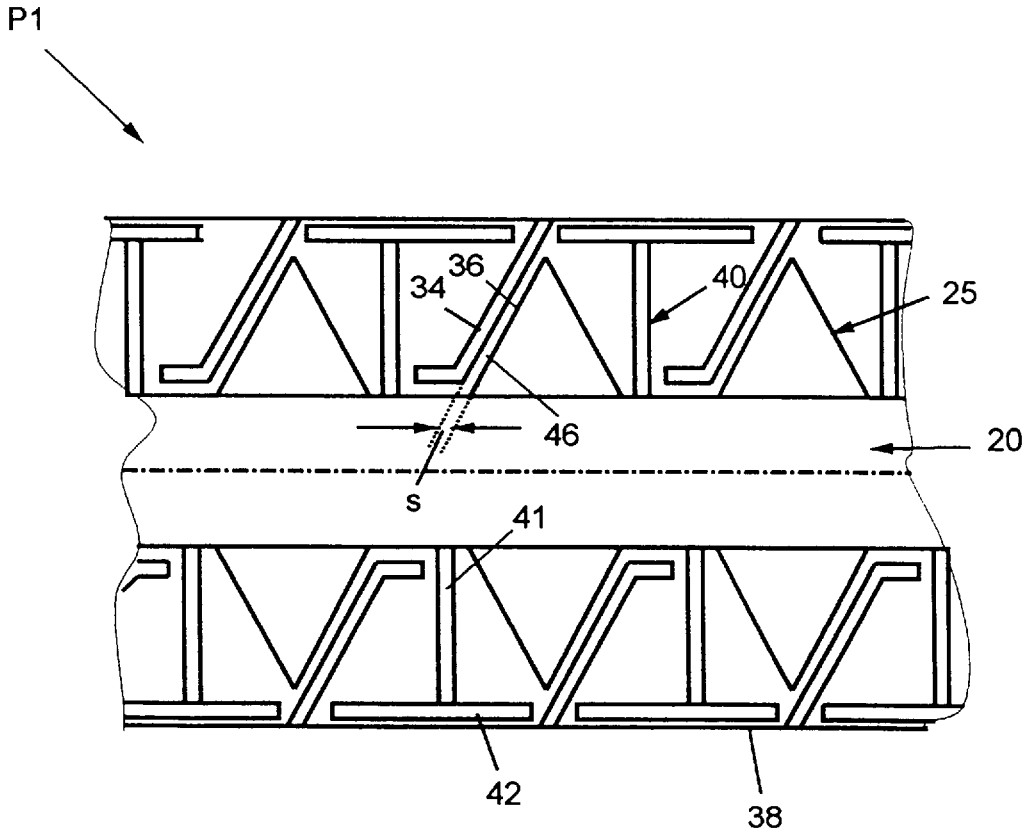
FIGS. 4 to 6 diagrammatically show partial longitudinal sections through other embodiments of kneader mixers, similar to FIG. 1.

In another embodiment of a kneader mixer $P_1$ shown in FIG. 4, further cleaning elements 40 are present on the kneader shaft 20 between the blade elements 25. Each cleaning element 40 is developed in T-shape, i.e. it has a trunk 41 which is rigidly attached to the kneader shaft 20 and on which there is a transverse beam 42. This transverse beam 42 extends approximately parallel to the axis A close to the housing inner wall 38. This transverse beam 42 can also be placed at an angle so that it cooperate upon a transport of the product in axial direction.

The transverse beam 42 has the job, in particular, of cleaning incrustations of product off from the housing inner wall 38. Furthermore, it acts also together with the housing inner wall 38 to form a kneading slot so that a shearing of the product and thus also an intimate mixing can take place in this kneading slot. The same is true, furthermore, also with regard to the scraping arm 34 in cooperation with the surface 36 of the blade elements 25.

Figure 5:
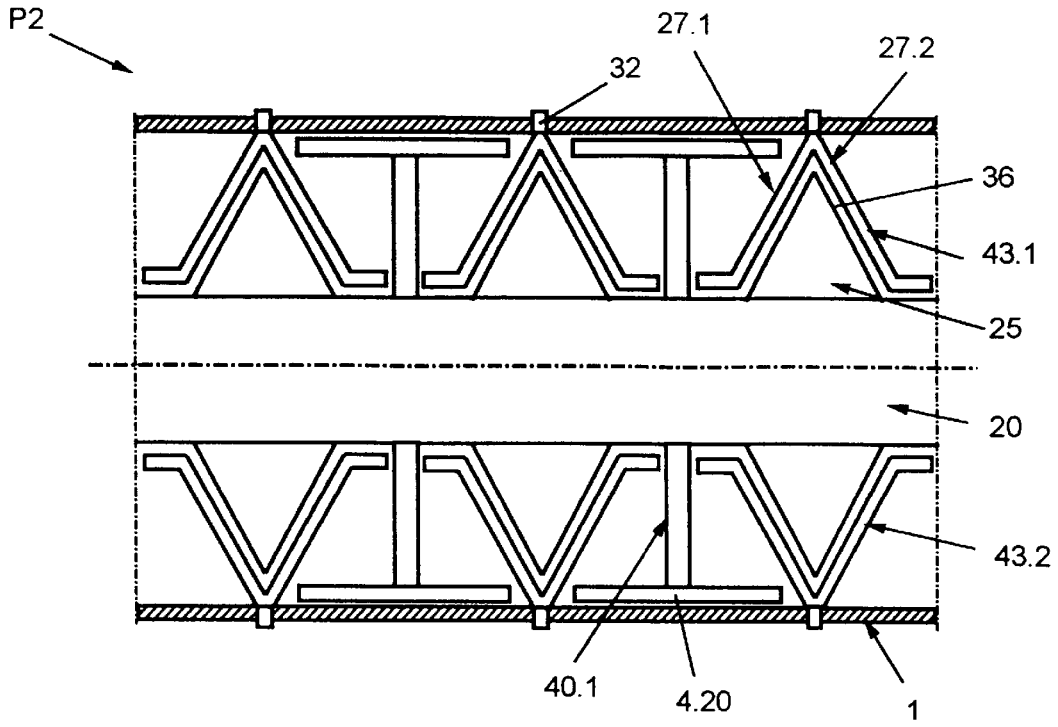

In accordance with FIG. 5, the kneading-support elements shown in FIG. 2 are combined in a kneader mixer $P_2$. This then results in a V-shaped fork element 43 which is arranged approximately parallel to the surface 36 of the blade elements 25. The fork element 43 thus consists of a kneading-support element 27.1 and a second kneading-support element 27.2, and has a foot 32 in common with it. It is obvious that each kneading-support element 27.1 and 27.2 consists of a scraper arm and a shaft scraper.

In FIG. 5 it is indicated that two such fork elements 43.1 and 43.2 lie opposite each other in the housing 1. The provision of only one fork element, to be sure, is sufficient.

With this arrangement, the T-shaped cleaning element 40.1 is located approximately in the center between two blade elements 25, its transverse beam 42 extending to close to the feet 32 of the adjacent fork elements 43.

Figure 6:
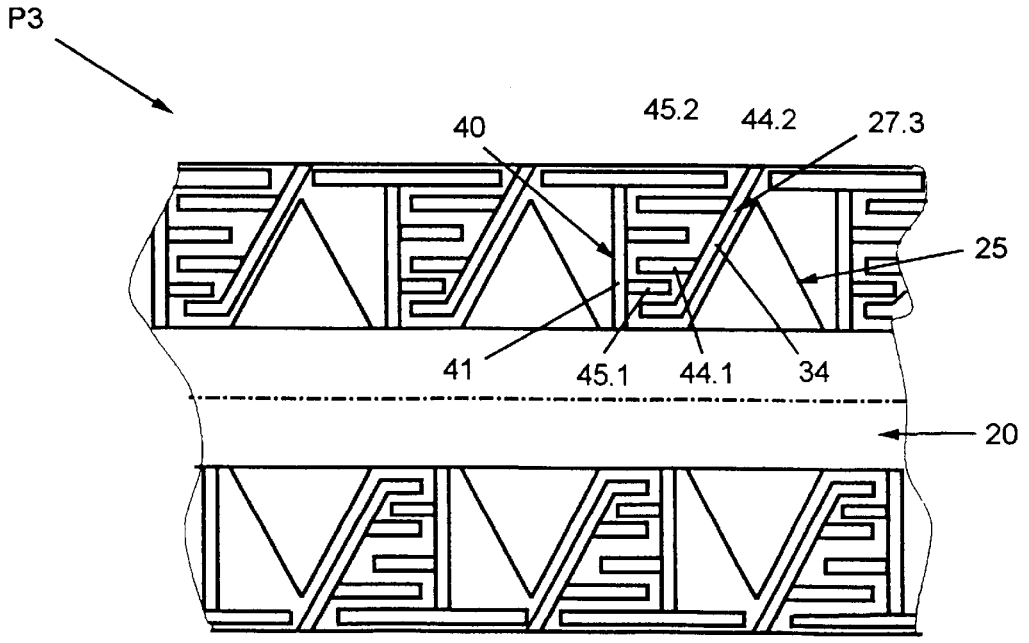

In order to avoid all dead space between two blade elements and the formation of any torus, a kneader mixer $P_3$ in accordance with FIG. 6 has, between two blade elements 25, the kneading-support elements 27.3 described above and T-shaped cleaning elements 40. To be sure, teeth 44.1, 44.2 as well as 45.1, 45.2, which mesh with each other, extend both from the scraper arm and from the trunk 41. This arrangement also changes, in mirror image, on opposite sides. In this way, there are formed between the teeth 44 and 45 a number of kneading slots which contribute essentially to improving the mixing of the product. Nevertheless, sufficient free space is available for the blade elements 25 so that the transport of the product takes place without difficulty.

The kneading-support elements 27 and fork elements 43 of the invention have the considerable advantage that they are adjustable radially with respect to the kneader shaft 20. For example, the foot 32 can be displaceable in the housing wall 33 and then locked in position again. In this way, a slot 46, shown in FIG. 4 between the surface 36 of the blade element 25 and the scraper arm 34, can be varied in its width s. Depending on the product, it is possible to clean the surface 36 more intensively or less intensively, and to change the kneading slot, which is formed by the slot 46. Paste products of high viscosity as a rule require a slot having a greater width s than paste products of lower viscosity. In the present embodiment this is shown only for the kneading element 27, but the same is true also of the fork element 43.

Furthermore, it is possible to develop these kneading-support elements 27 or fork elements 43 with the cross-section of a plowshare, turn them around their axis (twisting) or adjust them in or opposite the direction of rotation Z of the shaft 20. Merely by way of example reference is had here to European Patent Application 90 11 86 26.2 or Swiss Patent Application 01726/87-6.

In the same way there are also conceivable a large number of embodiments of the T-shaped cleaning element, such as indicated for instance in Swiss Patent Application 00 146/95-1.

We claim:

1. A kneader mixer comprising:

a housing;

a kneader shaft mounted in said housing for rotation about an axis of rotation (A), said kneader shaft having a plurality of blade elements of arranged on the kneader shaft along blade planes (E) which are substantially perpendicular to the axis of rotation (A) of the kneader shaft; and kneading-support elements mounted on said housing by means of foot portions and projecting between said blade elements, said foot portions also lying along planes (E) wherein the planes (E) are substantially central to both the foot portions and the blade elements.

2. A kneader mixer according to claim 1 wherein the blade elements, in cross section, are in the form of a triangle wherein a vertex of the triangle lies in the plane (E) and points toward the foot.

3. A kneader mixer according to claim 2 wherein the blade elements have recesses.

4. A kneader mixer according to claim 1 wherein the kneading-support elements have, adjoining the foot portion, a scraper arm which is bent off at an angle (w) with respect to plane (E).

5. A kneader mixer according to claim 4 wherein a shaft scraper extends from the scraper arm proximate and substantially axial to the kneader shaft.

6. A kneader mixer according to claim 4 wherein the scraper arm extends substantially parallel to a surface of the blade elements.

7. A kneader mixer according to claim 1 wherein at least two kneading-support elements are arranged radially apart in each blade plane, one kneading-support element scraping off the one side of a blade element and the other kneading-support element scraping off the opposite side of the blade element.

8. A kneader mixer according to claim 1 wherein two kneading-support elements are arranged as fork elements as mirror images of each other on the foot.

9. A kneader mixer according to claim 1 wherein at least one cleaning element is arranged on the kneader shaft between the blade elements.

10. A kneader mixer according to claim 9 wherein the cleaning element consists of a trunk with a transverse beam.

11. A kneader mixer according to claim 9 wherein teeth extend from the cleaning element and the kneading-support element and mesh with each other.

* * * * *